US008242391B2

(12) United States Patent
Wang et al.

(10) Patent No.: US 8,242,391 B2
(45) Date of Patent: Aug. 14, 2012

(54) SWITCH EQUIPPED WITH DRIVING DEVICE FOR ESTABLISHING ELECTRICAL CONNECTION AND ADAPTED TO POWER SUPPLYING APPARATUS AND POWER SUPPLYING APPARATUS PROVIDED WITH THE SAME

(75) Inventors: Kuan-Chun Wang, Taipei (TW); Vincent Kuo, Taipei (TW)

(73) Assignee: Kerio Technologies, Inc., Taipei (TW)

( * ) Notice: Subject to any disclaimer, the term of this patent is extended or adjusted under 35 U.S.C. 154(b) by 326 days.

(21) Appl. No.: 12/647,503

(22) Filed: Dec. 27, 2009

(65) Prior Publication Data

US 2010/0163390 A1 Jul. 1, 2010

(30) Foreign Application Priority Data

Dec. 31, 2008 (TW) ..... 97151927 A

(51) Int. Cl.
*H01R 31/08* (2006.01)

(52) U.S. Cl. ..... 200/43.05; 200/51 R; 200/51.09

(58) Field of Classification Search ..... 200/42.01, 200/42.02, 43.01, 43.04–43.07, 51 R, 51.02, 200/51.03, 51.05, 51.06, 51.09, 51.12; 439/62, 439/188, 630, 655, 131, 651, 911, 362, 894; 307/40, 41, 112, 141, 149; 323/282
See application file for complete search history.

(56) References Cited

U.S. PATENT DOCUMENTS

| | | | | |
|---|---|---|---|---|
| 4,319,102 | A | 3/1982 | Van Cleave et al. | |
| 4,494,143 | A * | 1/1985 | Lovick et al. | 380/227 |
| 4,580,017 | A | 4/1986 | Baynes et al. | |
| 4,871,886 | A * | 10/1989 | Vaughan et al. | 200/43.05 |
| 5,347,211 | A * | 9/1994 | Jakubowski | 323/351 |
| 5,952,632 | A * | 9/1999 | Irvine | 200/16 E |
| 6,933,452 | B2 * | 8/2005 | Liu | 200/51 R |
| 6,972,975 | B2 * | 12/2005 | Su | 363/146 |
| 7,183,508 | B2 * | 2/2007 | Kasai | 200/51.09 |
| 7,416,428 | B1 | 8/2008 | Hung et al. | |
| 7,751,216 | B2 * | 7/2010 | Su | 363/146 |
| 2001/0019907 | A1 * | 9/2001 | Glad et al. | 439/131 |
| 2003/0178977 | A1 | 9/2003 | Wu | |
| 2004/0259436 | A1 | 12/2004 | Su | |
| 2005/0259456 | A1 * | 11/2005 | Chiang | 363/146 |

(Continued)

FOREIGN PATENT DOCUMENTS

EP 1942562 7/2008

(Continued)

OTHER PUBLICATIONS

Abstract of TW97151924, Dec. 31, 2008.

(Continued)

*Primary Examiner* — Michael Friedhofer

(57) ABSTRACT

The present invention provides a switch that is equipped with a driving device for establishing electrical connection and adapted to a power supplying apparatus, and a power supplying apparatus provided with the same. The power supplying apparatus has a main body, an output port, a voltage-selecting circuit and a switch for commanding the voltage selecting circuit to select the output voltage that is to be output via the output port. The switch has a plurality of resilient conductive terminals and at least one driving device. The insertion of a driving device will selectively establish electrical connection among some of the resilient conductive terminals, enabling the switch to form a circuit for adjusting the output voltage of the power supplying apparatus.

6 Claims, 4 Drawing Sheets

U.S. PATENT DOCUMENTS

| | | | | |
|---|---|---|---|---|
| 2008/0252255 | A1* | 10/2008 | Chan | 320/112 |
| 2009/0142963 | A1* | 6/2009 | Motojima | 439/630 |
| 2011/0003491 | A1* | 1/2011 | Levy et al. | 439/78 |

FOREIGN PATENT DOCUMENTS

| | | |
|---|---|---|
| GB | 2404292 | 1/2005 |
| GB | 2416252 | 1/2006 |
| TW | 97151924 | 12/2008 |

OTHER PUBLICATIONS

U.S. Appl. No. 12/411,394, filed Mar. 26, 2009, Vincent Kuo.

* cited by examiner

SWITCH EQUIPPED WITH DRIVING DEVICE FOR ESTABLISHING ELECTRICAL CONNECTION AND ADAPTED TO POWER SUPPLYING APPARATUS AND POWER SUPPLYING APPARATUS PROVIDED WITH THE SAME

FIELD OF THE INVENTION

The present invention relates to a multi-position selective switch, and more particularly, to a switch equipped with a driving device for establishing electrical connection and adapted to a power supplying apparatus and a power supplying apparatus provided with the same.

DESCRIPTION OF THE RELATED ART

With the advance of modern technology, the current trend of electronic products is towards miniaturization, fashion and multi-functionality. As a result, conventional power supplies can no longer be built in the miniaturized electronics. Furthermore, conventional power supplies are normally designed to offer output power only at a single voltage level. This, together with the fact that they are inappropriately heavy in weight large in size, will cause consumers to face the inconvenience of dealing with the tangled wires and adapters associated with the power supplies and carrying different types of power supplies during leisure or business travel.

In response to consumer demands, power supplies that can provide variable output voltages by using a switch are now available in the market, which would significantly reduce the number of power supplies that one should have at home and further relieve the inconvenience of carrying different types of power supplies during leisure or business travel.

However, as shown in FIG. 1, a conventional power supply 1 is configured to adjust the output voltage by providing a slide switch 14 in the main body 11, where the slide switch 14 is associated with the output wire and adapted for adjusting the resistance of a variable resistor mounted within the slide switch 14, thereby operatively changing the voltage level of the electric power that is to be output via the output terminal 13. Such an arrangement can only be used for voltage conversion and the output voltage can still be altered during the operation of the power supply 1 by moving the slide switch 14. Given this, if the switch 14 is touched accidentally or intentionally, there may arise a serious risk for personal safety and damage to electronic appliances. This problem may become worse over time since the actuator 15 of the switch 14 will get loose gradually after a long time use, resulting in an increased probability of unstable output voltage.

In addition, more and more portable electronic devices, including some types of laptop computers and mobile phones and particularly the iPod® series products marketed by Apple Computer Corporation, are only equipped with built-in rechargeable batteries which cannot be removed and replaced by users. If the built-in batteries are out of order, the entire devices would have to be sent back to the companies to get checked over and repaired. To ameliorate the inconvenience caused thereby, the battery manufacturers have developed multi-functional external batteries which are suitable for being used as a backup power supplying apparatus, especially on the occasion when the built-in batteries are out of order. The universal external batteries of this type have to meet the voltage demands of various electronic devices and match in size with the charging ports of different dimensions. To meet such requirements, they are configured to offer switchable voltage output and equipped with exchangeable adapters that are normally provided in conventional power supplies and, therefore, the stability problems that happen in the power supplies as described above may come along.

Therefore, there exists a need for a switch equipped with a driving device for establishing electrical connection and adapted to a power supplying apparatus, which not only can stably provide a selected voltage to an electronic device, but also can vary the output voltage or current by virtue of variously designed driving devices. It is important that a user may utilize a single power supplying apparatus to satisfy the requirements of most of the major electronic appliances for electricity consumption, rather than keeping a tremendous number of power supplies. It is also important that the output voltage of the power supplying apparatus may be varied by inserting different driving devices, thereby reducing the risk caused either by the loosened actuator 15 or by accidental touching of the slide switch 14 of the power supply 1 as described above. Advantageously, the driving devices have a miniaturized structure with high portability that allows them to be easily manufactured at low cost and are less susceptible to electromagnetic interference. The switch according to the invention can ensure stable electrical power supply from an initiated power supplying apparatus, such that the electric output is always at a level demanded by the specifications of the electronic appliances to which it is connected, thereby ensuring the safety of using the electronic appliances.

SUMMARY OF THE INVENTION

Accordingly, an object of the present invention is to provide a switch for use in a power supplying apparatus, which is less susceptible to and even not damaged by electromagnetic interference.

Another object of the invention is to provide a switch for use in a power supplying apparatus, which is simple in structure and can be manufactured at low cost.

It is still another object of the invention to provide a switch for use in a power supplying apparatus, which is highly compatible with the smart card readers available in the market.

It is still another object of the invention to provide a power supplying apparatus, which is adapted to various electronic appliances since the output voltage thereof can be changed by virtue of variously designed driving devices. As a result, the number of power supplies that a customer has to possess is reduced significantly.

It is still another object of the invention to provide a switch for use in a power supplying apparatus, which ensures a certain degree of safety.

The present invention therefore provides a switch equipped with a driving device for establishing electrical connection and adapted to a power supplying apparatus, where the power supplying apparatus comprises a main body including an output port for outputting a selected output voltage out of a plurality of predetermined output voltages and a voltage selecting circuit built in the main body and electrically connected to the output port and adapted for selecting the output voltage that is to be output via the output port based on a command made by the switch, the switch comprising: a plurality of resilient conductive terminals extending in a longitudinal direction, each having a conductive contact portion; and at least one driving device configured to be movable relative to the resilient conductive terminals along a direction parallel to the longitudinal direction from a start position, where the driving device is away from the resilient conductive terminals, to a predetermined driving position, where at least two of the conductive contact portions of the resilient conductive terminals are driven by the driving device to be electrically connected with each other.

The present invention addresses the drawbacks mentioned above in an effective manner by providing an apparatus which is simple in structure, can be manufactured at low cost, has a basic identification function for ensuring security and is less susceptible to electromagnetic interference. The invention significantly reduces the number of power supplies that a person or a family should have at home and further relieves the inconvenience of carrying different types of power supplies during leisure or business travel.

BRIEF DESCRIPTION OF THE DRAWINGS

The above and other objects, features and effects of the invention will become apparent with reference to the following description of the preferred embodiments taken in conjunction with the accompanying drawings, in which.

DETAILED DESCRIPTION OF THE INVENTION

For the sake of elucidation of the invention, a single driving device is employed in the following embodiments for illustration of the technical relationship between the variably designed driving devices and the switch body, with a power supply or an external rechargeable battery exemplifying the power supplying apparatus.

Figure 1:
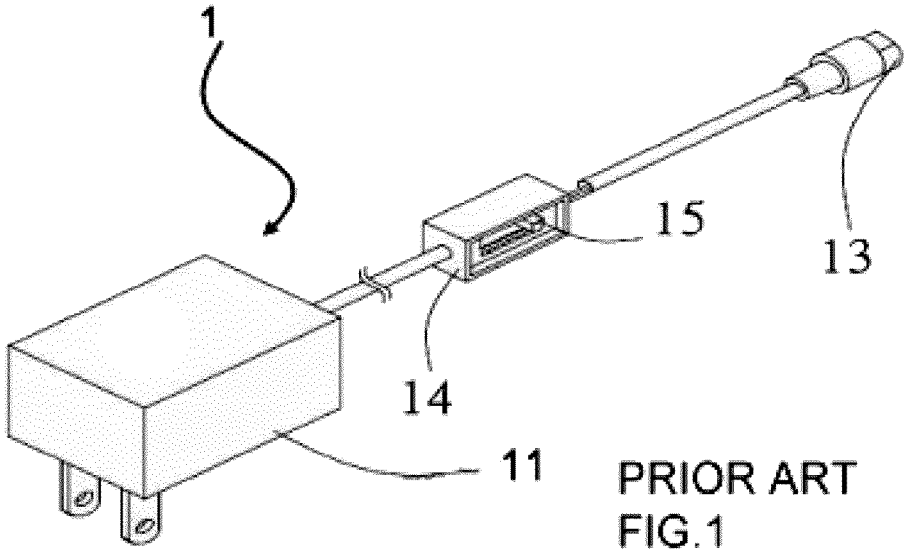
PRIOR ART FIG.1
FIG. 1 is a perspective view of a conventional power supply that offers variable output voltages, in which an actuator for varying the output voltage is exposed.
Figure 2:
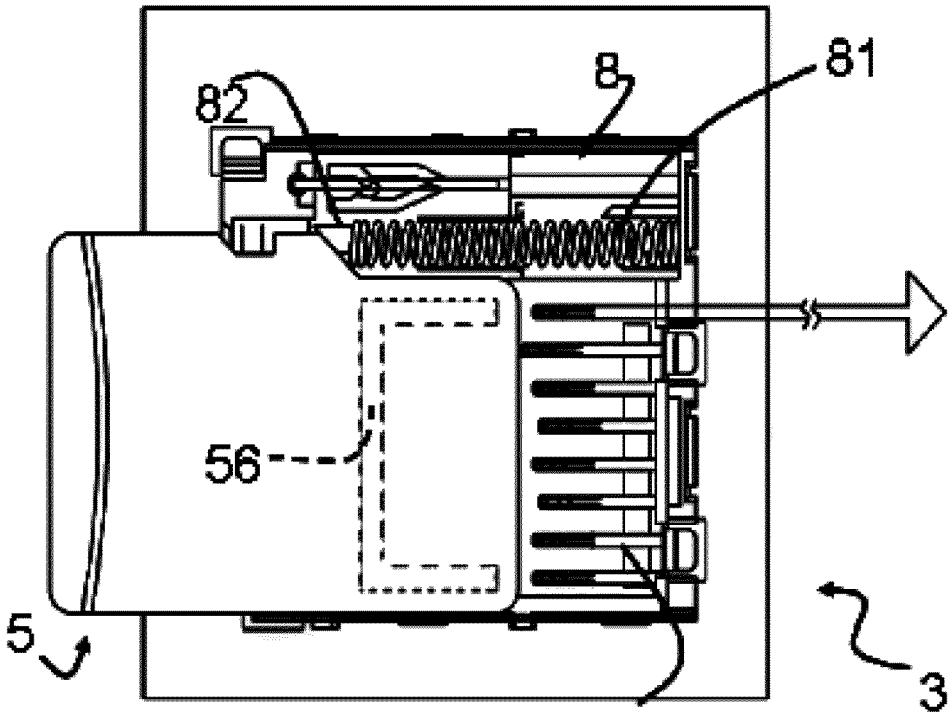
FIG. 2 is a top view of a switch body and a driving device according to the first embodiment of the invention.
Figure 3:
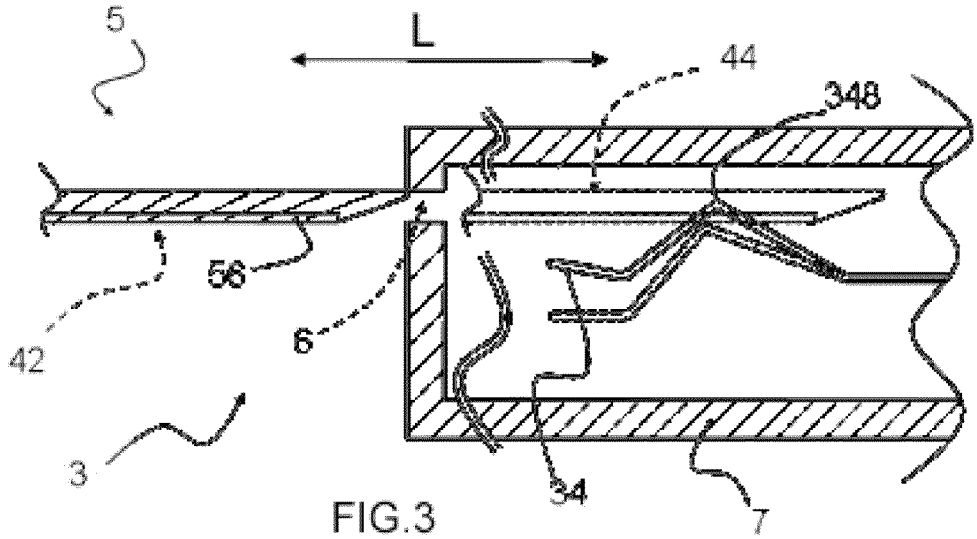
FIG. 3 is a schematic working diagram of the first embodiment of the invention, in which the structural parts of the invention move from their initial positions shown by the solid lines to the positions shown by phantom lines.
Figure 6:
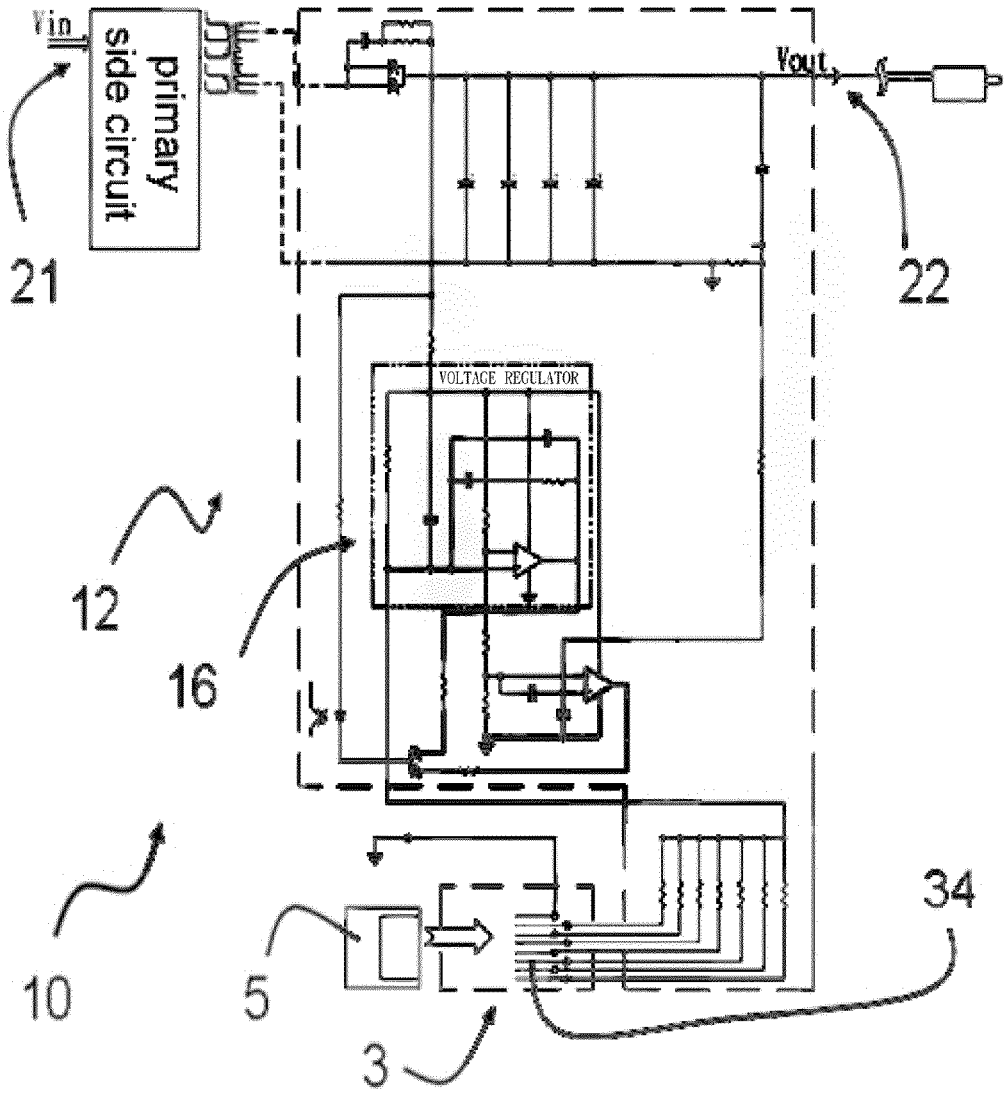
FIG. 6 is a circuit diagram for the first embodiment of the invention, showing that the output voltage can be changed by the switch.

As shown in FIGS. 2 and 3, a switch 3 according to the first embodiment of the invention has a body provided with eight resilient conductive terminals 34 which are parallel to and spaced apart from each other, and a driving device 5 which is configured to match with the body and has a non-conductive body and a conductive part 56. Among the eight resilient conductive terminals 34 in this embodiment, the uppermost terminal as indicated in FIG. 6 is designed to be the grounded terminal. The direction in which the resilient conductive terminals 34 extend is defined to be a longitudinal direction L. For the sake of elucidation, the part of a resilient conductive terminal 34 necessary for engaging the driving device 5 to constitute an electrically conductive path is defined to be a conductive contact portion 348.

Figure 4:
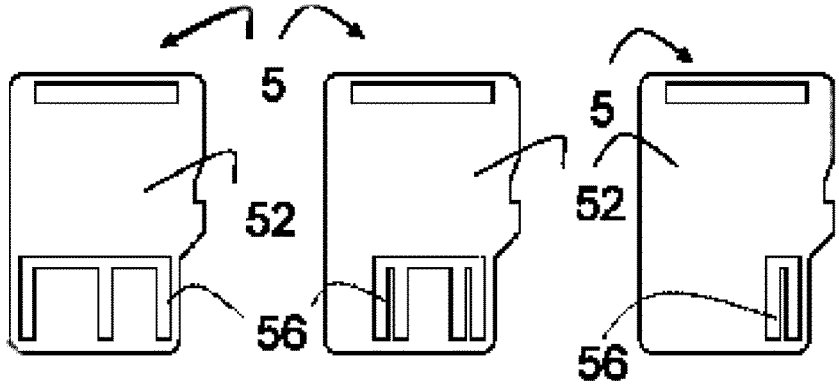
FIG. 4 is a top view showing three different driving devices according to the first embodiment of the invention.

As shown further in FIG. 4, the driving device 5 has a non-conductive body 52 and a conductive part 56, so as to allow a user to hold the non-conductive body 52 and insert the driving device 5 into the body of the switch in a direction which is generally parallel to the longitudinal direction L and toward the resilient conductive terminals 34. The conductive part 56 may vary in shape depending upon designs as shown in FIG. 4 and serve to establish electrical connection between at least two conductive contact portions 348. In this embodiment, the conductive part 56 is formed by coating a layer of conductive material, such as metal and graphite, onto an integrally formed driving card made of plastics.

Further, when the driving card 5 is inserted from a start position 42 and moved into the switch body via an insert slot 6 mounted on the left upper side of the dielectric housing 7 along a direction parallel to the longitudinal direction, the conductive part 56 starts to abut against the corresponding conductive contact portions 348 of the resilient conductive terminals 34 until the driving device 5 reaches a predetermined driving position 44 as shown by the phantom line in FIG. 3, whereby an engaged state shown by the phantom line is achieved. By virtue of the geometric shape of the conductive part 56, the predetermined resilient conductive terminals 34 are electrically connected to the grounded terminal. In this embodiment, the identification switch 3 may further include a latching/ejecting device 8 which has a push rod 82 and an elastic member 81 for driving the push rod 82. The latching/ejecting device 8 is configured to hold the driving device 5 when the driving device reaches the predetermined driving position 44 and subsequently eject outwardly the driving card 5 if the latched driving device 5 is being pushed inwardly.

Figure 5:
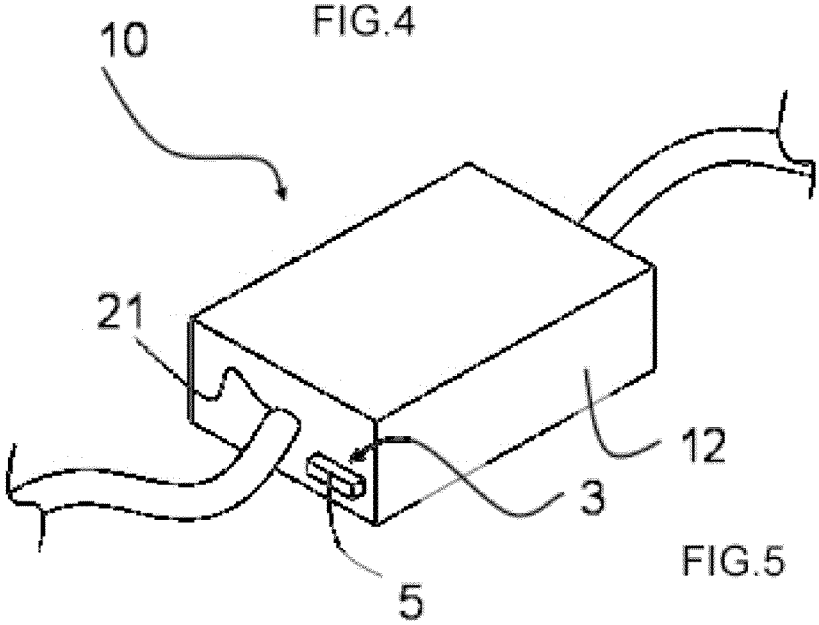
FIG. 5 is a schematic perspective view of the first embodiment of the invention, showing the profiles of a switch equipped with a driving device for establishing electrical connection and a power supplying apparatus provided with the same.

As shown further in FIG. 5, a power supply 10 is equipped with the identification switch 3 described above, in which the driving device 5 is inserted into the identification switch 3 located in the lower right side with respect to the input port 21 of the power supply 10 and functions to activate the switch mounted within the housing of the power supply 10. According to this embodiment, the power supply 10 is provided with circuitry shown in FIG. 6, where the electrical connection between the ground terminal and the selected resilient conductive terminal 34 will determine the resistance between the ground terminal and the voltage selecting circuit 16. When a voltage is fed to the body 12 through the input port 21 shown in FIG. 5, the identification switch 3 commands the voltage selecting circuit 16 to change the input voltage into an output voltage that is to be output via the output port 22.

Figure 7:
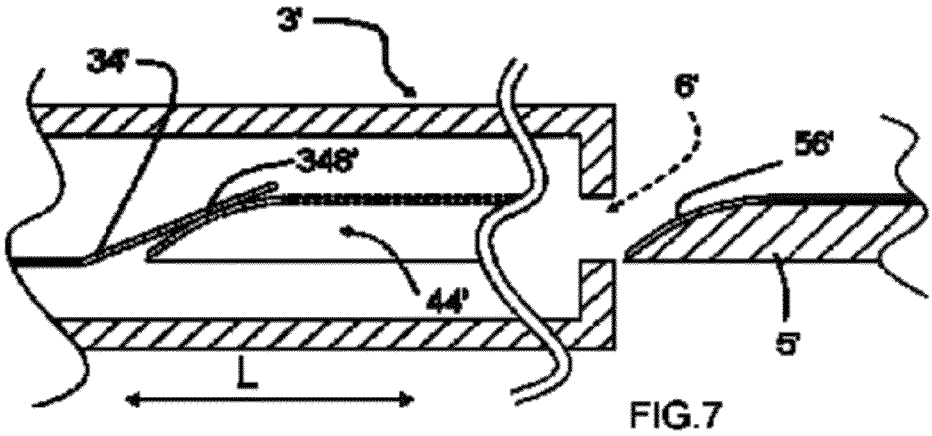
FIG. 7 is a side view of the second embodiment of the invention, showing the interior of a switch and the working relationship between the switch and a driving device.
Figure 8:
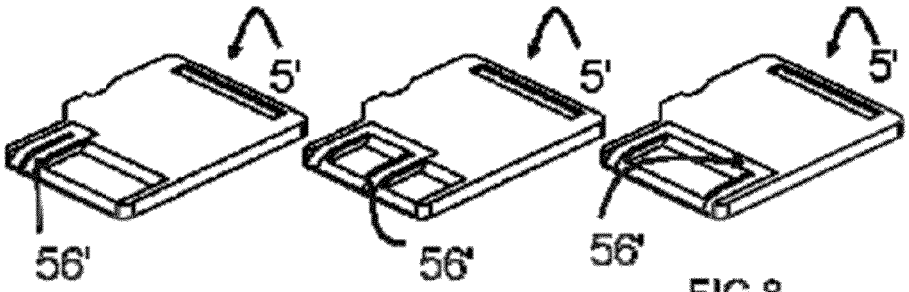
FIG. 8 is a schematic diagram illustrating three different driving devices that may be used in the second embodiment of the invention.

Of course, it would be appreciated by those skilled in the art that the embodiment described above, in which the identification switch is associated with a power supply and functions to switch the output voltage of the power supply from one to another, the driving device is configured to have a preferred profile, and the entrance where the driving device is to be inserted into and ejected out from the identification switch is advantageously located, is provided for illustrative purpose only and is not intended to limit the scope of the invention. As shown further in FIGS. 7 and 8, the conductive contact portions 348' of the resilient conductive terminals 34' according to the second embodiment of the invention are arranged in a direction opposite to the direction in which they are arranged in the first embodiment. The insert slot 6' is mounted in the switch as shown in the right central side of FIG. 7. The driving device 5' and the conductive part 56' are formed to have an arc-shaped front edge facing the resilient conductive terminals 34'. When the driving device 5 reaches a predetermined driving position 44', the conductive part 56' is brought in contact with the resilient conductive terminals 34'.

Figure 9:
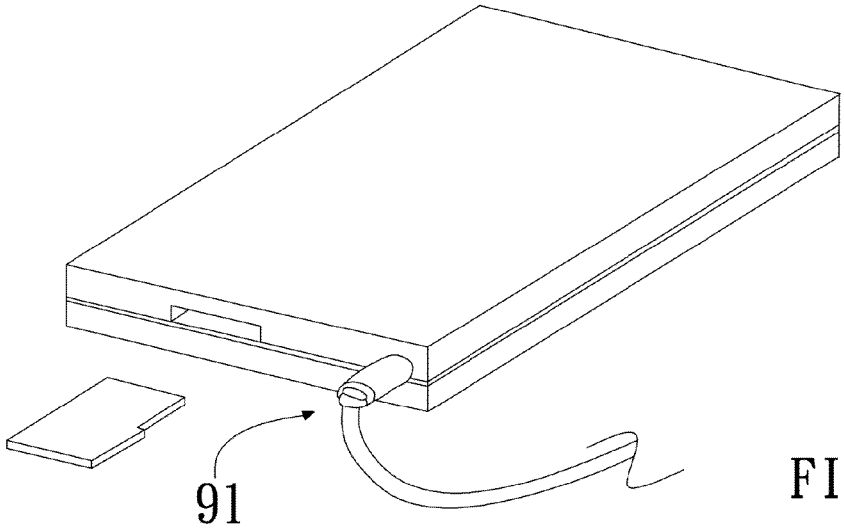
FIG. 9 is a perspective view of the third embodiment of the invention, showing a battery provided with a switch and the switch is equipped with a driving device for establishing electrical connection.

It should be noted that the use of the switch according to the invention is not confined to a power supply. FIG. 9 is a perspective view of the third embodiment of the invention, showing an external battery 9 equipped with an switch according to the invention. The battery 9 will be ready for supplying electric power at a selected level after an appropriate driving card is inserted into the insert slot of the switch, with the output port 91 being electrically connected to a charging port or a universal serial bus (USB) port of an electronic appliance.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

What is claimed is:

1. A switch equipped with a driving device for establishing electrical connection and adapted to a power supplying apparatus, where the power supplying apparatus comprises a main body including an output port for outputting a selected output voltage out of a plurality of predetermined output voltages and a voltage selecting circuit built in the main body and electrically connected to the output port and adapted for selecting the output voltage that is to be output via the output port based on a command made by the switch and an input port for receiving an input voltage and for transmitting the input voltage to the voltage selecting circuit, the switch comprising:

a plurality of resilient conductive terminals extending in a longitudinal direction, each having a conductive contact portion; and at least one driving device configured to be movable relative to the resilient conductive terminals along a direction parallel to the longitudinal direction from a start position, where the driving device is away from the resilient conductive terminals, to a predetermined driving position, where at least two of the conductive contact portions of the resilient conductive terminals are driven by the driving device to be electrically connected with each other;

wherein the driving device comprises:

a non-conductive body in a form of a card; and a conductive part in a form of a continuous and electrically uninterrupted layer of conductive material coated on the non-conductive body and for establishing electrical connection between the at least two of the conductive contact portions of the resilient conductive terminals through its electrical conductivity.

2. The switch according to claim 1, further comprising a dielectric housing for accommodating at least part of the resilient conductive terminals.

3. The switch according to claim 2, wherein the dielectric housing is formed with an insert slot for receiving the driving device, the insert slot being oriented at an angle with respect to the longitudinal direction.

4. The switch according to claim 3, further comprising a latching/ejecting device for holding the driving device at the predetermined driving position as the driving device reaches the predetermined driving position, and for moving the driving device toward the start position until the driving device reaches at least a predetermined distance away from the predetermined driving position when the driving device held at the predetermined driving position is subsequently pushed inwardly.

5. The switch according to claim 4, wherein the latching/ejecting device comprises a push rod and an elastic member for driving the push rod.

6. A power supplying apparatus, comprising:

a main body including an output port for outputting a selected output voltage out of a plurality of predetermined output voltages;

a voltage selecting circuit built in the main body and electrically connected to the output port;

an input port for receiving an input voltage and for transmitting the input voltage to the voltage selecting circuit; and a switch for commanding the voltage selecting circuit to select the output voltage that is to be output via the output port, comprising:

a plurality of resilient conductive terminals extending in a longitudinal direction, each having a conductive contact portion; and at least one driving device configured to be movable relative to the resilient conductive terminals along a direction parallel to the longitudinal direction from a start position, where the driving device is away from the resilient conductive terminals, to a predetermined driving position, where at least two of the conductive contact portions of the resilient conductive terminals are driven by the driving device to be electrically connected with each other;

wherein the driving device comprises:

a non-conductive body in a form of a card; and a conductive part in a form of a continuous and electrically uninterrupted layer of conductive material coated on the non-conductive body and for establishing electrical connection between the at least two of the conductive contact portions of the resilient conductive terminals through its electrical conductivity.

* * * * *